US009475118B2

(12) United States Patent
Mironets et al.

(10) Patent No.: US 9,475,118 B2
(45) Date of Patent: Oct. 25, 2016

(54) METAL POWDER CASTING

(75) Inventors: Sergey Mironets, Norfolk, CT (US); Wendell V. Twelves, Glastonbury, CT (US); Agnes Klucha, Colchester, CT (US)

(73) Assignee: United Technologies Corporation, Hartford, CT (US)

( * ) Notice: Subject to any disclaimer, the term of this patent is extended or adjusted under 35 U.S.C. 154(b) by 664 days.

(21) Appl. No.: 13/461,280

(22) Filed: May 1, 2012

(65) Prior Publication Data

US 2013/0294901 A1 Nov. 7, 2013

(51) Int. Cl.
*B22D 23/06* (2006.01)
*B22D 27/04* (2006.01)

(52) U.S. Cl.
CPC ..... *B22D 23/06* (2013.01); *B22D 27/04* (2013.01); *F05D 2230/21* (2013.01); *F05D 2230/22* (2013.01)

(58) Field of Classification Search
CPC .... B22D 23/06; B22D 27/04; B22D 27/045; B22D 30/00; F05B 2230/22; F05B 2230/21; F05B 2230/211; F05D 2230/21; F05D 2230/22
USPC ..... 164/80, 111, 112, 113, 98, 122, 125, 164/338.1; 415/173.1, 175–178, 173.5, 415/174.5
See application file for complete search history.

(56) References Cited

U.S. PATENT DOCUMENTS 1,144,034 A * 6/1915 Giolotti ..... B22D 18/06 164/122.1
3,677,324 A * 7/1972 Higginbotham et al. . 164/122.1
3,862,840 A 1/1975 Nayar
3,982,934 A 9/1976 Wentzell
4,227,927 A 10/1980 Black et al.
4,310,292 A 1/1982 Carlson et al.
4,355,057 A 10/1982 Slaughter
4,407,775 A 10/1983 Holman, Jr. et al.
4,470,953 A * 9/1984 Bruce ..... 419/6
4,663,241 A 5/1987 Doherty et al.
4,822,438 A 4/1989 Williams, Jr. et al.
4,851,188 A * 7/1989 Schaefer et al. ..... 419/9
4,867,224 A * 9/1989 Wakita ..... B22D 27/045 164/122.1
4,915,605 A 4/1990 Chan et al.

(Continued)

FOREIGN PATENT DOCUMENTS

DE 102011105688 A1 * 12/2012
EP 0072175 2/1983

(Continued)

OTHER PUBLICATIONS

International Search Report and Written Opinion for International Application No. PCT/US2013/038999 completed on Sep. 25, 2013.

(Continued)

*Primary Examiner* — Christopher Verdier
*Assistant Examiner* — Adam W Brown
(74) *Attorney, Agent, or Firm* — Carlson, Gaskey & Olds, P.C.

(57) ABSTRACT

A method of component forming according to an exemplary aspect of the present disclosure includes, among other things, positioning a metal powder in a mold cavity, melting the metal powder within the mold cavity, and cooling the melted metal powder to form a component.

13 Claims, 4 Drawing Sheets

(56) References Cited

U.S. PATENT DOCUMENTS

| | | | | |
|---|---|---|---|---|
| 5,021,213 | A | 6/1991 | Nishio et al. | |
| 5,931,214 | A * | 8/1999 | Spicer | B22D 15/00 164/122.1 |
| 6,321,885 | B1 | 11/2001 | Wendt | |
| 6,709,619 | B2 | 3/2004 | MacDonald et al. | |
| 6,746,506 | B2 * | 6/2004 | Liu et al. | 75/228 |
| 7,457,344 | B2 * | 11/2008 | Fishman et al. | 373/150 |
| 7,687,021 | B2 * | 3/2010 | Imbourg et al. | 419/8 |
| 7,832,456 | B2 * | 11/2010 | Calnan et al. | 164/15 |
| 2003/0012677 | A1 * | 1/2003 | Senini | 419/6 |
| 2005/0211408 | A1 * | 9/2005 | Bullied et al. | 164/122.2 |
| 2008/0202644 | A1 * | 8/2008 | Grassi et al. | 148/538 |
| 2009/0317287 | A1 * | 12/2009 | Hu | C30B 11/003 420/443 |
| 2010/0251854 | A1 * | 10/2010 | Koch | 75/10.12 |
| 2012/0073303 | A1 * | 3/2012 | McCarren et al. | 60/752 |

FOREIGN PATENT DOCUMENTS

| | | | |
|---|---|---|---|
| JP | 4944936 | | 4/1974 |
| JP | 59218256 | | 12/1984 |
| JP | 0299261 | | 4/1990 |
| JP | 2007180373 | A | 7/2007 |
| KR | 100861287 | B1 | 10/2008 |
| KR | 20100134346 | A | 12/2010 |

OTHER PUBLICATIONS

International Preliminary Report on Patentability for PCT Application No. PCT/US2013/038999, mailed Nov. 13, 2014.

Extended European Search Report for Application No. 13784346.2 dated Apr. 1, 2016.

* cited by examiner

METAL POWDER CASTING

BACKGROUND

This disclosure relates generally to casting a component and, more particularly, to casting using metal powder.

Conventional casting techniques involve heating a metal to form liquid metal, and then moving the liquid metal into a mold cavity. The liquid metal cools and hardens within the mold cavity to form a cast component.

There are several problems with conventional casting techniques. As an example, completely filling the mold cavity with liquid metal is difficult, especially when casting components having relatively complex geometries. Incomplete fills may result in undesirable voids and weak areas in the cast component.

SUMMARY

A method of component forming according to an exemplary aspect of the present disclosure includes, among other things, positioning a metal powder in a mold cavity, melting the metal powder within the mold cavity, and cooling the melted metal powder to form a component.

In a further non-limiting embodiment of the foregoing method of component forming, the metal powder may be heated above a melt point of the metal powder during the melting.

In a further non-limiting embodiment of either of the foregoing methods of component forming, all the metal powder within the mold cavity may be completely melted.

In a further non-limiting embodiment of any of the foregoing methods of component forming, the melting may be a quiescent melting.

In a further non-limiting embodiment of any of the foregoing methods of component forming, the metal powder may be uncompressed.

In a further non-limiting embodiment of any of the foregoing methods of component forming, the method may include heating a mold having the mold cavity to melt the metal powder.

In a further non-limiting embodiment of any of the foregoing methods of component forming, the method may include varying thermal energy levels in areas of the mold to melt the metal powder at different rates.

In a further non-limiting embodiment of any of the foregoing methods of component forming, the method may include coating surfaces of the mold with an alumina or other protective materials before the positioning.

In a further non-limiting embodiment of any of the foregoing methods of component forming, the method may include heating the mold using a conventional vacuum, vacuum hot press, or vacuum induction furnace.

In a further non-limiting embodiment of any of the foregoing methods of component forming, the melted metal powder may include spherical solidus particles.

In a further non-limiting embodiment of any of the foregoing methods of component forming, the method may include controlling the cooling using an induction furnace coil.

In a further non-limiting embodiment of any of the foregoing methods of component forming, the method may include reusing the mold.

In a further non-limiting embodiment of any of the foregoing methods of component forming, metal powder may comprise a first type of metal powder positioned in a first area of the mold cavity and a second type of metal powder positioned in a second area of the mold cavity, the first type of metal powder being higher-strength relative to the second type of metal powder. That is, the mold cavity may be filed with different metal powders.

An example mold assembly according to an exemplary aspect of the present disclosure includes, among other things, a mold providing a cavity and a heating element configured to heat the mold to melt a metal powder within the cavity.

In a further non-limiting embodiment of the foregoing mold assembly, the heating element may comprise an induction furnace coil.

In a further non-limiting embodiment of either of the foregoing mold assemblies, the mold may be a reusable mold.

In a further non-limiting embodiment of either of the foregoing mold assemblies, the mold may be configured to hold the melted metal powder as the melted metal powder cools.

An example cast component assembly according to an exemplary aspect of the present disclosure includes, among other things, a component. At least a portion of the component is formed from metal powder that has been melted and cooled within a mold cavity.

In a further non-limiting embodiment of the foregoing mold assembly, the portion is formed from metal powder that has been completely melted.

In a further non-limiting embodiment of either of the foregoing mold assemblies, the component may be a turbomachine component.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
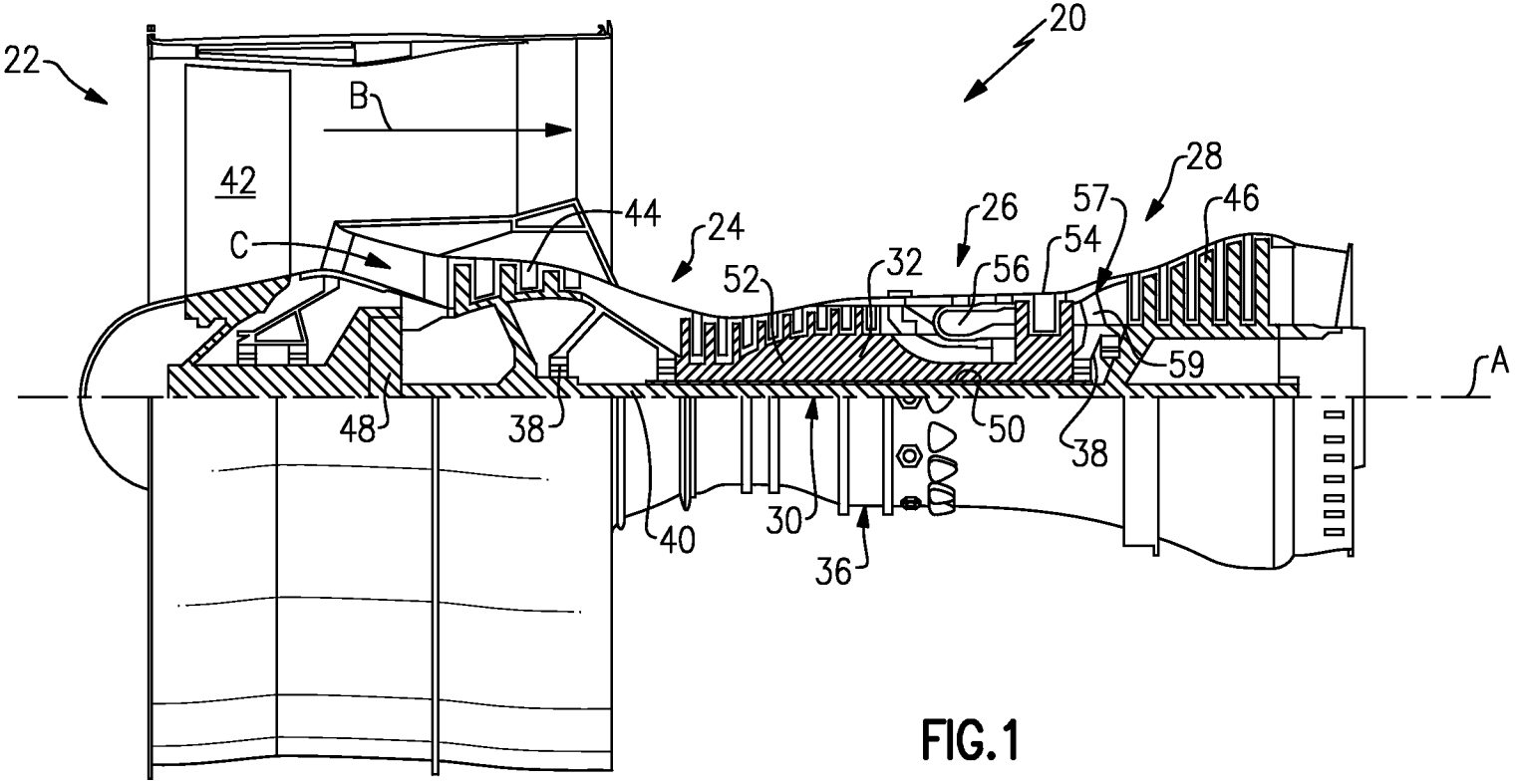
FIG. 1 shows a cross-sectional, schematic view of an example turbomachine.
Figure 2:
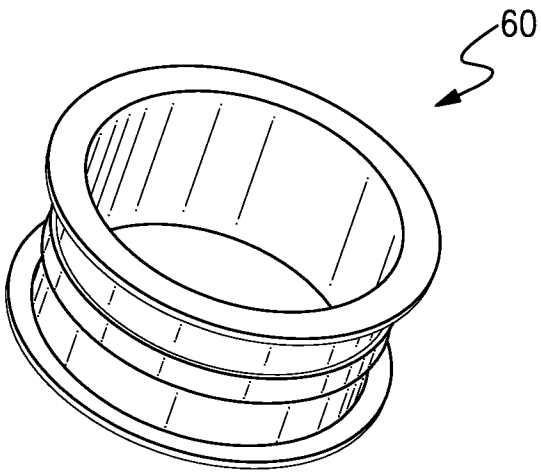
FIG. 2 shows a flow of an example method of forming a component of the turbomachine of FIG. 1.
Figure 4:
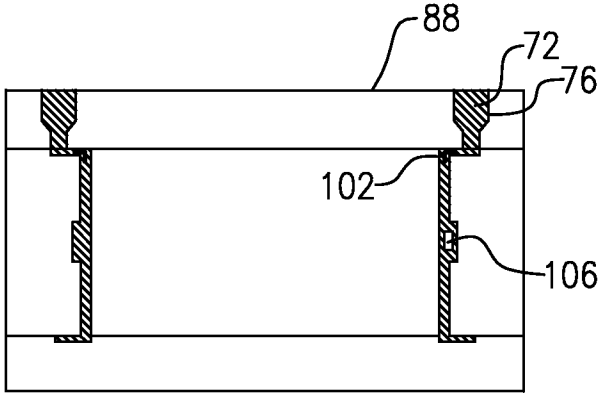
FIG. 4 shows a mold used in the method of FIG. 2.
Figure 3:
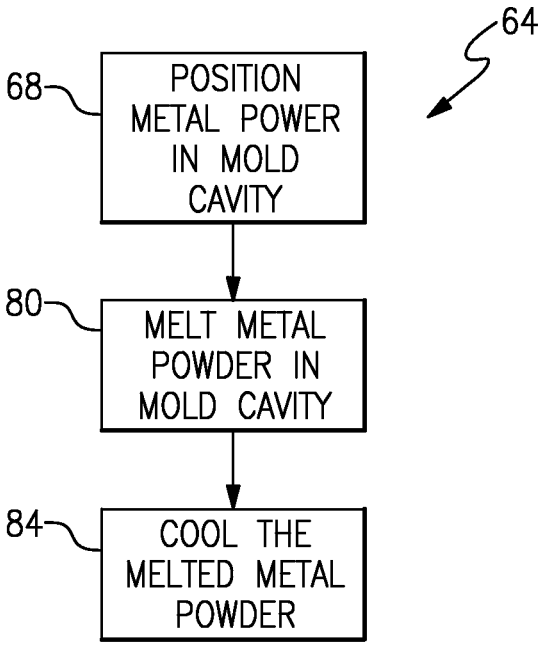
FIG. 3 shows an example component formed according to the method of FIG. 2.
Figure 5:
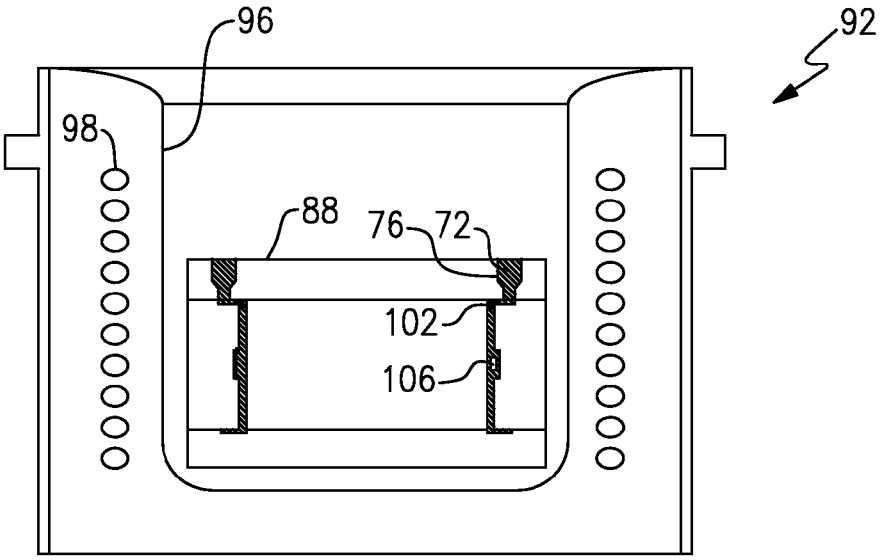
FIG. 5 shows an example furnace for heating the mold of FIG. 4.
Figure 6:
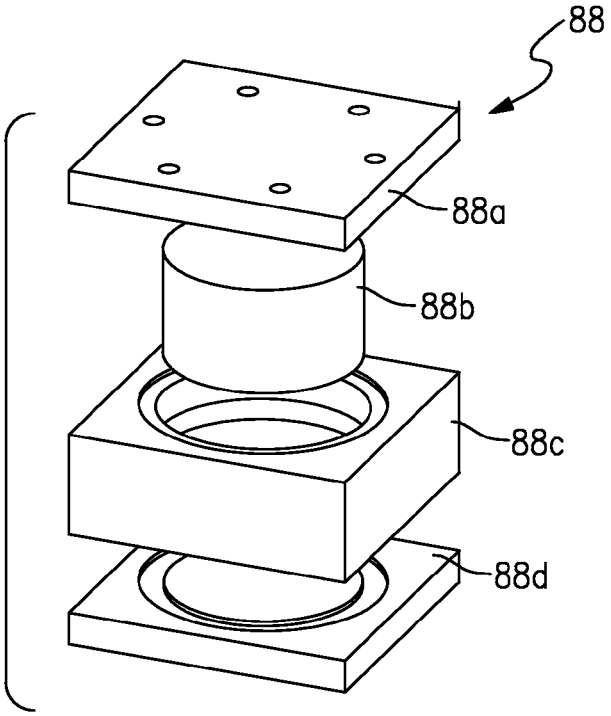
FIG. 6 shows an exploded view of the mold of FIG. 4.

FIG. 1 schematically illustrates an example turbomachine, which is a gas turbine engine 20 in this example. The gas turbine engine 20 is a two-spool turbofan gas turbine engine that generally includes a fan section 22, a compressor section 24, a combustion section 26, and a turbine section 28.

Although depicted as a two-spool turbofan gas turbine engine in the disclosed non-limiting embodiment, it should be understood that the concepts described herein are not limited to use with turbofans. That is, the teachings may be applied to other types of turbomachines and turbine engines including three-spool architectures.

In the example engine 20, flow moves from the fan section 22 to a bypass flowpath B or a core flowpath C. Flow from the bypass flowpath B generates forward thrust. The compressor section 24 drives air along the core flowpath C. Compressed air from the compressor section 24 communicates through the combustion section 26. The products of combustion expand through the turbine section 28.

The example engine 20 generally includes a low-speed spool 30 and a high-speed spool 32 mounted for rotation about an engine central longitudinal axis A relative to an engine static structure 36. The low-speed spool 30 and the high-speed spool 32 are rotatably supported by several bearing systems 38. It should be understood that various bearing systems 38 at various locations may alternatively, or additionally, be provided.

The low-speed spool 30 generally includes an inner shaft 40 that interconnects a fan 42, a low-pressure compressor 44, and a low-pressure turbine 46. The inner shaft 40 is connected to the fan 42 through a geared architecture 48 to drive the fan 42 at a lower speed than the low-speed spool 30.

The high-speed spool 32 includes an outer shaft 50 that interconnects a high-pressure compressor 52 and high-pressure turbine 54.

The inner shaft 40 and the outer shaft 50 are concentric and rotate via bearing systems 38 about the engine central longitudinal axis A, which is collinear with the longitudinal axes of the inner shaft 40 and the outer shaft 50.

The combustion section 26 includes a circumferentially distributed array of combustors 56 generally arranged axially between the high-pressure compressor 52 and the high-pressure turbine 54.

In some non-limiting examples, the engine 20 is a high-bypass geared aircraft engine. In a further example, the engine 20 bypass ratio is greater than about six (6 to 1).

The geared architecture 48 of the example engine 20 includes an epicyclic gear train, such as a planetary gear system or other gear system. The example epicyclic gear train has a gear reduction ratio of greater than about 2.3 (2.3 to 1).

The low-pressure turbine 46 pressure ratio is pressure measured prior to inlet of low-pressure turbine 46 as related to the pressure at the outlet of the low-pressure turbine 46 prior to an exhaust nozzle of the engine 20. In one non-limiting embodiment, the bypass ratio of the engine 20 is greater than about ten (10 to 1), the fan diameter is significantly larger than that of the low pressure compressor 44, and the low-pressure turbine 46 has a pressure ratio that is greater than about 5 (5 to 1). The geared architecture 48 of this embodiment is an epicyclic gear train with a gear reduction ratio of greater than about 2.5 (2.5 to 1). It should be understood, however, that the above parameters are only exemplary of one embodiment of a geared architecture engine and that the present disclosure is applicable to other gas turbine engines including direct drive turbofans.

In this embodiment of the example engine 20, a significant amount of thrust is provided by the bypass flow B due to the high bypass ratio. The fan section 22 of the engine 20 is designed for a particular flight condition—typically cruise at about 0.8 Mach and about 35,000 feet. This flight condition, with the engine 20 at its best fuel consumption, is also known as "Bucket Cruise" Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example engine 20 is less than 1.45 (1.45 to 1).

Low Corrected Fan Tip Speed is the actual fan tip speed divided by an industry standard temperature correction of Temperature divided by 518.7^0.5. The Temperature represents the ambient temperature in degrees Rankine. The Low Corrected Fan Tip Speed according to one non-limiting embodiment of the example engine 20 is less than about 1150 fps (351 m/s).

Referring to FIGS. 2 to 6 with continuing reference to FIG. 1, the gas turbine engine 20 includes a component 60 formed according to a component forming method 64. The component 60 is a compressor case of the gas turbine engine 20 in this example. The method 64 could be used to form various other types of components, including other turbomachine components, such as exhaust ducts, and components of other assemblies, such as automotive assemblies.

The method 64 includes a step 68 of positioning a metal powder 72 in a mold cavity 76, a step 80 of melting the metal powder 72 in the mold cavity 76, and a step 84 of cooling the metal powder 72 after the melting. The melted metal powder hardens when cooled to form the component 60.

The positioning step 68 involves any technique suitable for communicating this metal powder 72, in powder form, into the mold cavity 76. In one specific example, the metal powder 72 is poured into the mold cavity 76, and mold 88 providing the mold cavity 76 is vibrated to settle the metal powder within the mold cavity 76. The metal powder 72 may be compressed or uncompressed within the mold cavity 76.

The melting step 80, in one example, involves heating the mold 88 and the metal powder 72 within an induction furnace 92. In such an example, the mold 88 having the metal powder 72 within the mold cavity 76 is placed within a crucible 96 of the furnace 92. Current is then moved through a heating element, such as induction furnace coils 98 surrounding the crucible 96, to add thermal energy to the mold 88 and the metal powder 72. Areas of the mold 88 may be heated at different rates to achieve a desired melt of the metal powder within the mold cavity 76.

The induction furnace 92 may be a vacuum induction furnace. In such example, a vacuum may be drawn on the area within the crucible 96 such that the mold 88 having the metal powder 72 is within the vacuum. A vacuum environment helps reduce the likelihood of trapped gasses and oxygen contamination. Other example induction furnaces may incorporate a conventional vacuum or vacuum hot press.

In other examples, energy assisted metal flow, such as pressure, ultrasound, centrifugal forces, and other methods as appropriate may be used to enhance the molten metal fluidity inside the mold 88.

The heating of the mold 88 and the metal powder 72 is controlled to provide a quiescent melt of the metal powder 72. In some examples, all the metal powder 72 within the mold cavity 76 is heated to, or beyond, the liquidus point. That is, all the metal powder is completely melted, not some portion of the metal powder.

Heating the metal powder 72 below the liquidus point forms a metal slurry, which conforms to the shape of the mold cavity 76. The example metal slurry includes spherical solidus particles, which limits undesirable dendrite growth and facilitates better metal flow. The metal slurry is then cooled to provide the component 60. The cooling in the step 84 is controlled to reduce areas of high stress in the component 60. Controlling the cooling rate may include sequentially shutting off some of the coils 98 before others of the coils 98 to cool some areas of the mold cavity 76 and metal slurry at different rates than other areas.

Once cooled, the component 60 is removed from the mold 88 and may be trimmed and the surfaces finished prior to installation within the gas turbine engine 20.

In this example, the metal powder 72 is a metal powder alloy, such as Inconel 625, and the mold 88 is graphite. Some or all of the surfaces of the mold cavity 76 may be lined with a protective material, such as a high purity alumina.

The example mold 88 includes several separate pieces 88*a* to 88*d*. Some or all of the mold pieces 88*a* to 88*d* may be reused to mold components in addition to the component 60. Utilizing multiple pieces 88*a* to 88*d* facilitates a mold cavity having a relatively complex geometry, and filling such the mold cavity with the metal powder 72. Relatively complex geometries include thin walled panels.

Filling the mold cavity 76 may take place in stages as the mold pieces 88*a* to 88*d* are assembled to from the mold 88. For example, the portions of the mold cavity 76 provided by the piece 88*d* may be filled with the metal powder 72 prior to assembling the remaining pieces 88*a* to 88*c*.

In some examples, select areas of the mold cavity 76 are filled with component strengthening structures 102, such silicon carbide fibers. The metal powder 72 surrounds these structures 102 during the step 68. The structures 102 are typically located at areas of potential weakness in the component 60. The structures 102 are held in position by the component 60 after the component 60 is formed.

In some examples, select areas of the mold cavity 76 are filled with other items, such as sensors 106, such as isotope markers. The metal powder 72 surrounds these sensors 106 during the step 68. The sensors 106 are held in position by the component 60 after the component 60 is formed.

In some examples, threaded inserts, studs, fittings, etc., are placed in the mold cavity 76. The powdered metal 72 surrounds these components during the step 68. The components could also be co-molded or over-molded with the powdered metal 72.

In some examples, different types of metal powder 72 may be used within the mold cavity 76. For example, areas of the mold cavity 76 that correspond to projected weak areas of the component 60 may be filled with a relatively high-strength metal powder, whereas other areas are filled with a relatively low-strength (and lower cost) metal powder.

Features of the disclosed examples include a method capable of producing components having relatively complex geometries due to the elimination of run length limitations associated with filling a mold cavity with a liquid material.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A component forming method, comprising:

positioning a metal powder in a mold cavity;

melting the metal powder within the mold cavity using a first heating element of an induction furnace coil on a first side of the mold cavity and a second heating element of the induction furnace coil on an opposing, second side of the mold cavity;

cooling the melted metal powder to form a component; and controlling the cooling using the induction furnace coil without moving the melted metal powder relative to the induction furnace coil, wherein the controlling comprises sequentially shutting off at least one coil of the induction furnace coil before at least one other coil of the induction furnace coil.

2. The component forming method of claim 1, wherein the metal powder is heated above a melt point of the metal powder during the melting.

3. The component forming method of claim 1, including heating a mold having the mold cavity to melt the metal powder.

4. The component forming method of claim 3, including varying thermal energy levels in areas of the mold to melt the metal powder at different rates.

5. The component forming method of claim 4, including coating surfaces of the mold with an alumina or other protective material before the positioning.

6. The component forming method of claim 3, including heating the mold using a vacuum induction furnace, conventional vacuum furnace or vacuum hot press.

7. The component forming method of claim 3, including heating the mold using an energy assisted metal flow.

8. The component forming method of claim 1, wherein the melted metal powder includes spherical solidus particles.

9. The component forming method of claim 1, including reusing the mold.

10. The component forming method of claim 1, wherein the metal powder comprises a first type of metal powder positioned in a first area of the mold cavity and a second type of metal powder positioned in a second area of the mold cavity, the first type of metal powder being higher-strength relative to the second type of metal powder.

11. The component forming method of claim 1, further comprising, during the melting, heating a first area of the mold cavity at a different rate than a different, second area of the mold cavity without moving the component relative to the induction furnace coil.

12. The component forming method of claim 1, wherein the mold cavity is a mold cavity of a vacuum induction furnace.

13. The component forming method of claim 1, further comprising melting the metal powder without moving the mold cavity relative to any portion of the induction furnace coil.

* * * * *